US006743990B1

(12) United States Patent
Wong

(10) Patent No.: US 6,743,990 B1
(45) Date of Patent: Jun. 1, 2004

(54) VOLUME ADJUSTMENT APPARATUS AND METHOD FOR USE

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/317,293

(22) Filed: Dec. 12, 2002

(51) Int. Cl.[7] ..... H01H 29/00
(52) U.S. Cl. ..... 200/182; 200/193
(58) Field of Search ..... 200/182, 188, 200/185, 193, 214, 233, 221, 227, 228; 335/78, 47, 57, 58, 50–56; 361/704, 700, 699; 310/328, 363, 365

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkewitsch et al. |
| 3,529,268 | A | 9/1970 | Rauterberg |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | SHO 36-18575 | 10/1961 |
| JP | SHO 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99/46624 | 12/1999 |

OTHER PUBLICATIONS

Marvin Glenn Wong, "A Piezoelectrically Actuated Liquid Metal Switch", May 2, 2002, patent application (pending), 12 pages of specification, 5 pages of claims, 1 page of abstract, and 10 sheets of drawings (Figs. 1–10).

Joonwon Kim et al., "A Micromechanical Switch with Electrostatically Driven Liquid–Metal Droplet", 4 pages.

Jonathan Simon et al., "A Liquid–Filled Microrelay with a Moving Mercury Microdrop", Journal of Microelectromechanical Systems, vol. 6, No. 3, Sep. 1977, pp. 208–216.

Marvin Glenn Wong, "Laser Cut Channel Plate For A Switch", Patent application (Agilent SN: 10/317932 filed Dec. 12, 2002), 11 pages of specifications, 5 pages of claims, 1 page of abstract, and 4 sheets of formal drawings (Fig. 1–10).

Homi C. Bhedwar et al., "Ceramic Multilayer Package Fabrication", Nov. 1989, Electronic Materials Handbook, vol. 1 Packaging, Section 4: pp. 460–469.

US2002/0037128 A1, Mar. 28, 2002, Geardus Johannes Burger, et al.

US2002/0146197 A1, Oct. 10, 2002, Yoon–Joong Yong.

US2002/0150323 A1, Oct. 17, 2002, Naoki Nishida, et al.

US2002/0168133 A1, Nov. 14, 2002, Takeshi Saito.

US2003/0035611 A1, Feb. 20, 2003, Youchun Shi.

TDB–ACC–NO: NB8406827, "Integral Power Resistors For Aluminum Substrate", IBM Technical Disclosure Bulletin, Jun. 1984, US, vol. 27, Issue No. 1B, p. 827.

*Primary Examiner*—Elvin Enad
*Assistant Examiner*—Lisa Klaus

(57) ABSTRACT

A volume adjustment apparatus for a switch. One embodiment of the volume adjustment apparatus may comprise a plate member sized to fit over a main channel in the switch displaces an excess of a liquid switching element from the main channel of the switch. At least one collection chamber is formed in the plate member overlapping the main channel of the switch to receive the displaced excess liquid switching element.

8 Claims, 5 Drawing Sheets

U.S. PATENT DOCUMENTS 3,600,537 A 8/1971 Twyford
3,639,165 A 2/1972 Rairden, III
3,657,647 A 4/1972 Beusman et al.
4,103,135 A 7/1978 Gomez et al.
4,200,779 A 4/1980 Zakurdaev et al.
4,238,748 A 12/1980 Goullin et al.
4,245,886 A 1/1981 Kolodzey et al.
4,336,570 A 6/1982 Brower et al.
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,639,999 A * 2/1987 Daniele ..... 438/34
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,105,433 A * 4/1992 Eisele et al. ..... 372/50
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 * 5/2003 Zarev ..... 219/209
6,633,213 B1 * 10/2003 Dove ..... 335/78
6,646,527 B1 * 11/2003 Dove et al. ..... 335/47

* cited by examiner

VOLUME ADJUSTMENT APPARATUS AND METHOD FOR USE

BACKGROUND

Liquid metal micro-switches (LIMMS) have been developed to provide reliable switching capability using compact hardware (e.g., on the order of microns). The small size of LIMMS makes them ideal for use in hybrid circuits and other applications where smaller sizes are desirable. Besides their smaller size, advantages of LIMMS over more conventional switching technologies include reliability, the elimination of mechanical fatigue, lower contact resistance, and the ability to switch relatively high power (e.g., about 100 milli-Watts) without overheating, to name just a few.

According to one design, LIMMS have a main channel partially filled with a liquid metal. The liquid metal may serve as the conductive switching element. Drive elements provided adjacent the main channel move the liquid metal through the main channel, actuating the switching function.

During assembly, the volume of liquid metal must be accurately measured and delivered into the main channel. Failure to accurately measure and/or deliver the proper volume of liquid metal into the main channel could cause the LIMM to fail or malfunction. For example, too much liquid metal in the main channel could cause a short. Not enough liquid metal in the main channel may prevent the switch from making a good connection.

The compact size of LIMMS makes it especially difficult to accurately measure and deliver the liquid metal into the main channel. Even variations in the tolerance of the machinery used to deliver the liquid metal may introduce error during the delivery process. Variations in the dimensions of the main channel itself may also introduce volumetric error.

SUMMARY OF THE INVENTION

An embodiment of the invention is a volume adjustment apparatus for a switch. The volume adjustment apparatus may comprise a plate member sized to fit over a main channel in the switch. The plate member displaces an excess of a liquid switching element from the main channel of the switch. At least one collection chamber formed in the plate member overlapping the main channel of the switch receives the displaced excess liquid switching element.

Another embodiment of the invention is a method for adjusting the volume of a liquid switching element in a switch, comprising: depositing the liquid switching element on a substrate; moving a plate member toward the substrate, wherein an excess portion of the liquid switching element moves into at least one collection chamber in the plate member; and removing the plate member with the excess portion of liquid switching element from the substrate.

Yet other embodiments are also disclosed.

BRIEF DESCRIPTION OF THE DRAWINGS

Illustrative and presently preferred embodiments of the invention are shown in the drawings, in which:

FIG. 2(*b*) is a plan view of the substrate portion of the switch shown in FIG. 2(*a*), the switch being in a second state;

FIG. 9(*b*) is another side view of the switch, shown in a second state.

DETAILED DESCRIPTION

Figure 1:
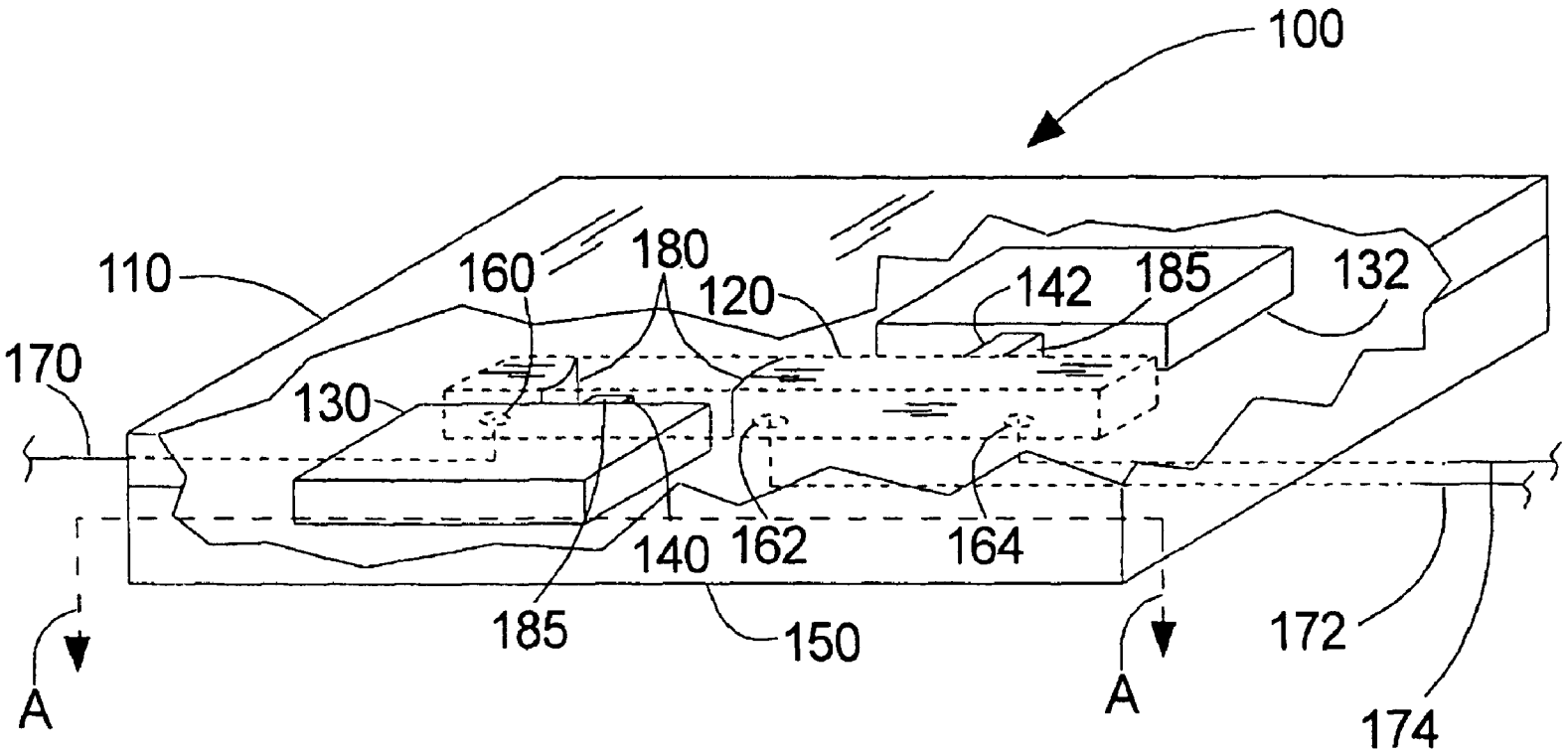
FIG. 1 is a perspective view of one embodiment of a switch.

One embodiment of a switch 100 is shown in FIG. 1 and described herein according to the teachings of the invention. Switch 100 comprises a substrate 150 defining a portion of a main channel 120, drive chambers 130, 132, and subchannels 140, 142 fluidically connecting the drive chambers 130, 132 to the main channel 120. A cover plate 110 is assembled to the substrate 150, and further defines the main channel 120, drive chambers 130, 132, and subchannels 140, 142.

In one embodiment, the cover plate 110 is manufactured from glass, although other suitable materials may also be used (e.g., ceramic, plastics, a combination of materials). The substrate 150 may be manufactured from a ceramic material, although other suitable materials may also be used.

Figure 2A:
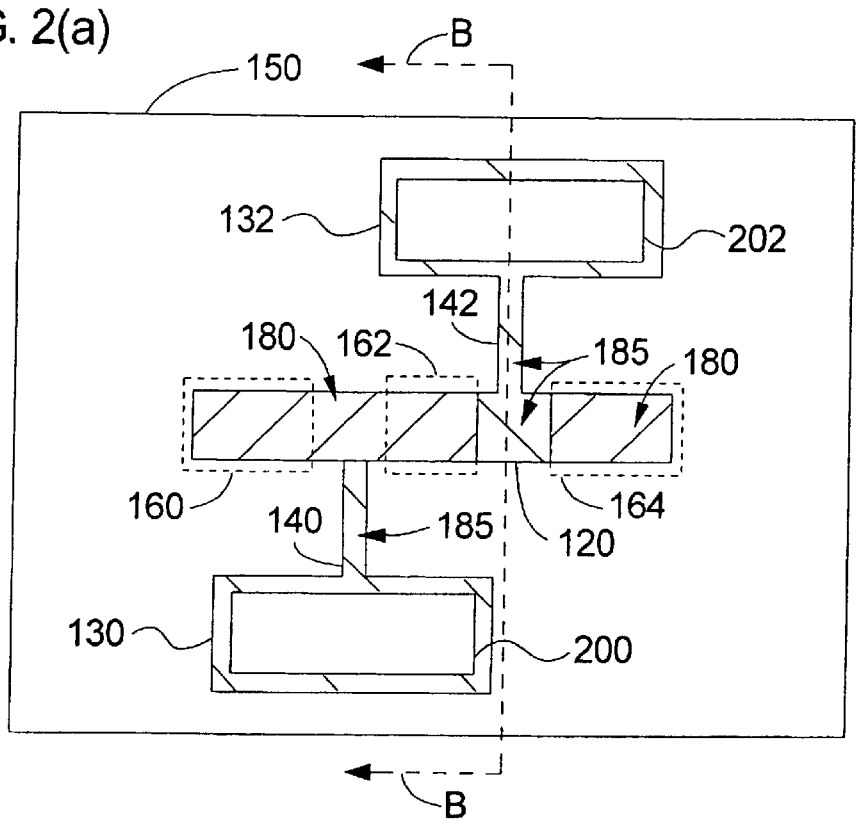
FIG. 2(*a*) is a plan view of a substrate portion of the switch according to one embodiment of the invention, the switch being in a first state.
Figure 2B:
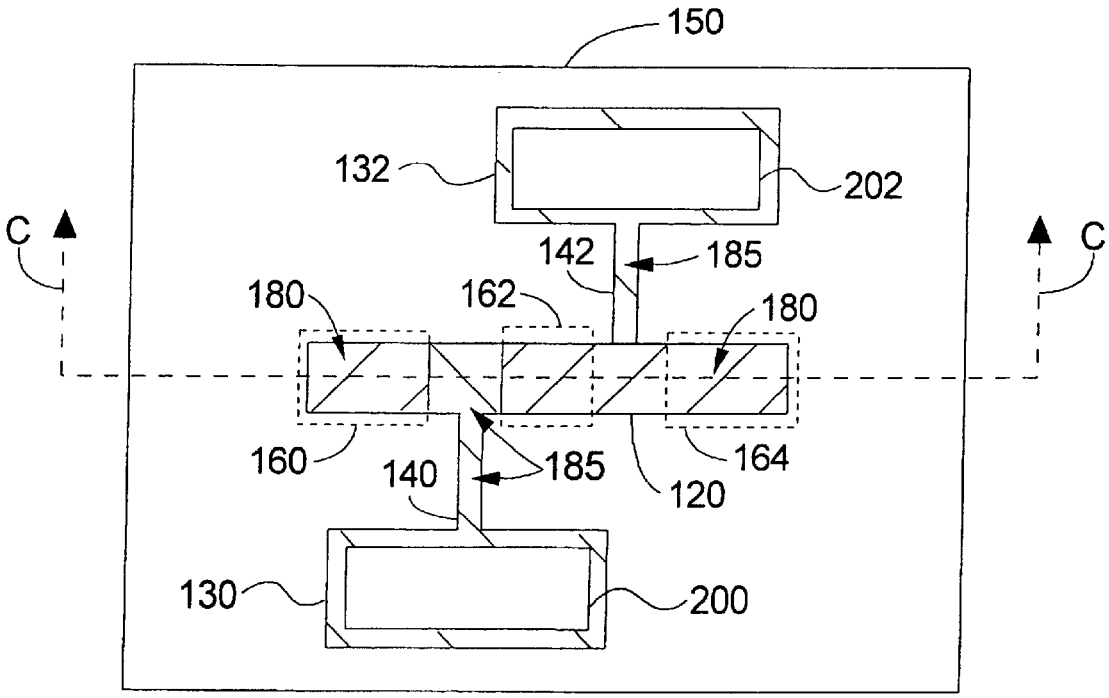

Substrate 150 is shown in more detail in FIG. 2(*a*) and FIG. 2(*b*). It is noted that FIG. 2(*a*) and FIG. 2(*b*) are cross sectional views of the substrate 150 such as would be seen taken along line A—A in FIG. 1.

Channels may be etched into the substrate 150 (e.g., by sand blasting) and covered by the cover plate 110, thereby defining the main channel 120, drive chambers 130, 132, and subchannels 140, 142. Other embodiments for manufacturing the cover plate 110 and substrate 150 are also contemplated as being within the scope of the invention.

Of course it is understood that the main channel 120, drive chambers 130, 132, and/or subchannels 140, 142 may be defined in any suitable manner. For example, the main channel 120, drive chambers 130, 132, and/or subchannels 140, 142 may be entirely formed within either the cover plate 110 or the substrate 150. In other embodiments, the switch 100 may comprise additional layers, and the main channel 120, drive chambers 130, 132, and/or subchannels 140, 142 may be partially or entirely formed through these layers.

It is also understood that the switch 100 is not limited to any particular configuration. In other embodiments, any suitable number of main channels 120, drive chambers 130, 132, and/or subchannels 140, 142 may be provided and suitably linked to one another. Similarly, the main channels 120, drive chambers 130, 132, and/or subchannels 140, 142 are not limited to any particular geometry. Although according to one embodiment, the main channels 120, drive chambers 130, 132, and/or subchannels 140, 142 have a semi-elliptical cross section, in other embodiments, the cross section may be elliptical, circular, rectangular, or may have any other suitable geometry.

According to the embodiment shown in FIG. 1, switch 100 may also comprise a plurality of electrodes or contact pads 160, 162, 164 which are exposed to the interior of the main channel 120. Leads 170, 172, and 174 may be provided through the substrate 150 and may carry electrical current to/from the contact pads 160, 162, 164 during operation of the switch 100.

Of course the switch 100 may be provided with any number of contact pads, including more or less than shown and described herein. The number of contact pads may depend at least to some extent on the intended use of the switch 100.

In addition, the contact pads are shown and described herein as having circuit traces extending through the substrate 150. Other embodiments, however, are also contemplated as being within the scope of the invention. For example, the circuit traces may be coplanar with the contact pads. Likewise, the circuit traces may be linked to other devices by any suitable connection, such as wire-bonds, ribbon wire-bonds, solder bumps, etc.

The main channel 120 is partially filled with a liquid switching element 180. In one embodiment, the liquid switching element 180 is a conductive fluid (e.g., mercury (Hg)). As such, the liquid switching element 180 may serve as a conductive path between the contact pads 160, 162 or contact pads 162, 164. Alternatively, an opaque fluid may be used for an optical switch (not shown). The opaque fluid is used to block and unblock optical paths, as will be readily understood by one skilled in the art after having become familiar with the teachings of the invention.

The subchannels 140, 142 may be at least partially filled with a driving fluid 185. Preferably, the driving fluid 185 is a non-conductive fluid, such as an inert gas or liquid. The driving fluid 185 may be used to move the liquid switching element 180 within the main channel 120.

Drive elements 200, 202 (FIG. 2(*a*) and 2(*b*)) may be provided in drive chambers 130, 132. Drive elements 200, 202 may comprise, for example, heat-producing means (e.g., thin-film resistors) which heat the driving fluid 185 and cause it to expand. Other embodiments, now known or later developed, are also contemplated as being within the scope of the invention. For example, drive elements 200, 202 may comprise acoustic or pump means, to name only a few. In any event, the drive elements 200, 202 can be operated to force the driving fluid 185 into the main channel 120, causing the liquid switching element 180 to "part" and move within the main channel 120.

By way of illustration, switch 100 is shown in a first state in FIG. 2(*a*) wherein the liquid switching element 180 makes a conductive path between contact pads 160 and 162. Drive element 200 may be operated to effect a change in state of switch 100, as shown in FIG. 2(*b*). Operation of the drive element 200 causes the driving fluid 185 to move, forcing it through the subchannel 140 into the main channel 120. The driving fluid 185 parts the liquid switching element 180 and causes it to move toward the other end of the main channel 120. The liquid switching element 180 is shown in FIG. 2(*b*) making a conductive path between contact pads 162 and 164. Similarly, drive element 202 can be operated to change the state of the switch 100 back to the first state.

Suitable modifications to switch 100 are also contemplated as being within the scope of the invention, as will become readily apparent to one skilled in the art after having become familiar with the teachings of the invention. For example, the present invention is also applicable to optical micro-switches (not shown). Also see, for example, U.S. Pat. No. 6,323,447 of Kondoh et al. entitled "Electrical Contact Breaker Switch, Integrated Electrical Contact Breaker Switch, and Electrical Contact Switching Method", and U.S. patent application Ser. No. 10/137,691 and filed on May 2, 2002 of Marvin Wong entitled "A Piezoelectrically Actuated Liquid Metal Switch", each hereby incorporated by reference for all that is disclosed.

The foregoing description of one embodiment of switch 100 is provided in order to better understand its operation. It should also be understood that the present invention is applicable to any of a wide range of other types and configurations of switches, now known or that may be developed in the future.

Switch 100 may comprise a substrate 150, as shown in more detail according to one embodiment in FIG. 2(*a*) and FIG. 2(*b*). Note that the substrate 150 is a plan view as it appears from the side that abuts the cover plate 110 (e.g., the top of the substrate 150). Substrate 150 has a main channel 120 formed therein. Contact pads 160, 162, 164 are spaced apart from one another in the main channel 120.

Contact pads 160, 162, 164 may be made of a wettable material. Where the contact pads 160, 162, 164 serve to make electrical connections, contact pads 160, 162, 164 are made of a conductive material, such as metal.

Preferably, subchannels 140, 142 open to the main channel 120 in the space provided between the contact pads 160, 162, 164. Such an arrangement serves to enhance separation of the liquid switching element 180 during a switching operation such, as described above.

Figure 5:
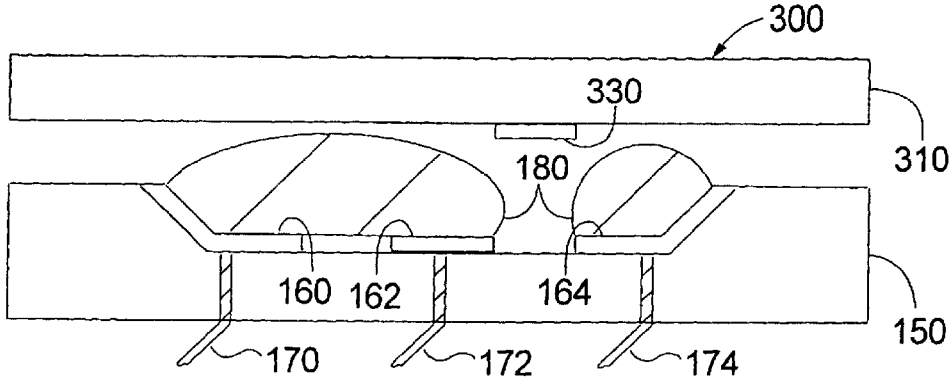
FIG. 5 is a side view of the volume adjustment apparatus and substrate portion of the switch, showing a liquid switching element deposited on the substrate.

A liquid switching element 180 may be deposited on the contact pads 160, 162, 164, as shown according to one embodiment in FIG. 5. Preferably, the volume of liquid switching element 180 is more than needed to fulfill a switching function. An excess portion of the liquid switching element 180 is removed from the main channel 120 during assembly of the switch 100, as will be discussed in more detail below.

It is noted that the liquid switching element 180 preferably extends between two of the adjacent contact pads (e.g., 160, 162), forming a connection therebetween. In addition, the liquid switching element 180 preferably does not extend between two of the other contact pads (e.g., 162, 164), forming a "break" in the switch 100. During operation, the liquid switching element 180 is moved so that it forms a connection between the other two contact pads (e.g., 162, 164) and breaks the connection between the previously connected contact pads (e.g., 160, 162).

Figure 3:
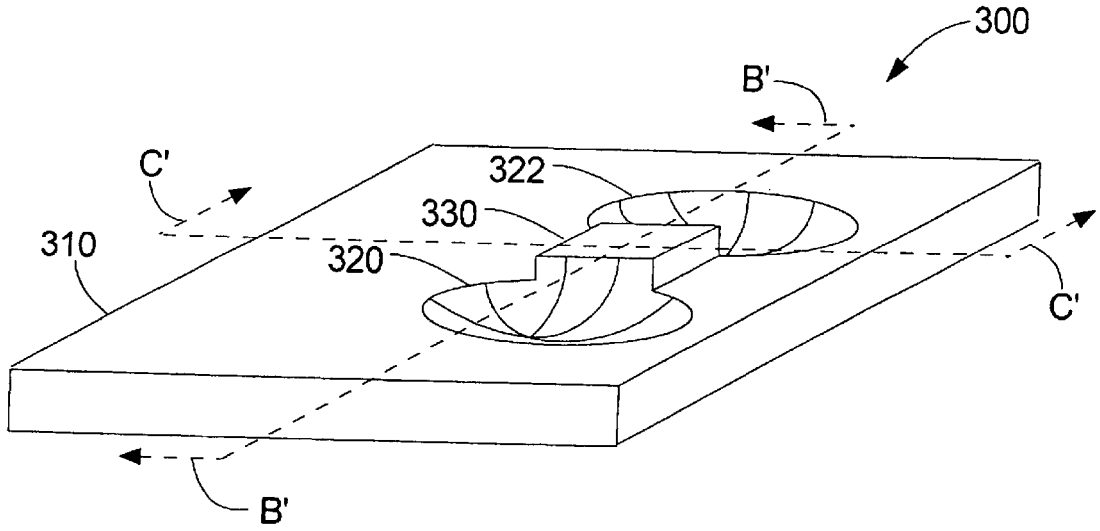
FIG. 3 is a side view of a volume adjustment apparatus according to one embodiment of the invention, for adjusting the volume of liquid switching element in the switch.

Excess of the liquid switching element 180 may be removed with a volume adjustment apparatus 300, shown according to one embodiment of the invention in FIG. 3. Volume adjustment apparatus 300 may comprise a plate member 310 having at least one collection chamber 320, 322 formed therein, and a displacement tab 330.

Of course volume adjustment apparatus 300 may be made from any suitable material. In one embodiment, volume adjustment apparatus 300 is made of borosilicate glass, although other suitable materials may also be used (e.g., glass, ceramic, plastics, a combination of materials).

Assembly of the switch 100 will be described in more detail below. Briefly, however, the volume adjustment device 300 may be substantially aligned with and positioned adjacent the substrate 150. Volume adjustment device 300 may then be moved toward the substrate 150 to remove excess of the liquid switching element 180 from the main channel 120. The volume adjustment device 300 displaces the excess portion of the liquid switching element 180 into collection chambers 320, 322, as illustrated in FIG. 4 by arrows 400, 402.

Figure 4:
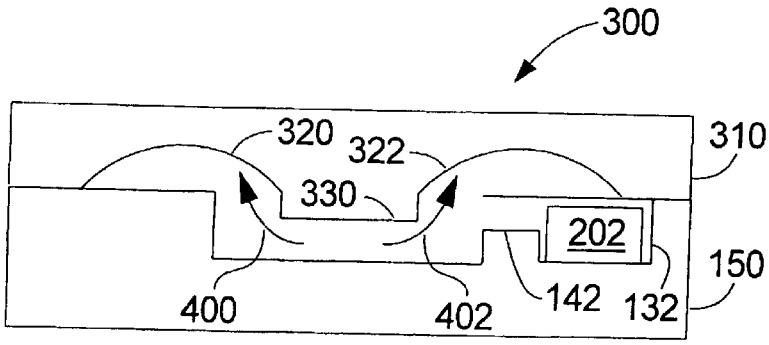
FIG. 4 is a side view of the volume adjustment apparatus, shown positioned adjacent the substrate portion of the switch to illustrate removal of the liquid switching element into collection chambers in the volume adjustment apparatus.

Before continuing, it should be noted that FIG. 4 is a cross sectional view of the volume adjustment apparatus 300 shown abutting the substrate 150. The view of substrate 150 is such as would be seen taken along line B—B in FIG. 2(*a*). The view of volume adjustment apparatus 300 is such as would be seen taken along line B'—B' in FIG. 3.

More specifically, displacement tab 330 of the volume displacement apparatus 300 contacts the liquid switching element 180. Liquid switching element 180 preferably wets to the displacement tab 330 and collection chamber 320, 322. Displacement tab 330 provides a path for the liquid switching element 180 to move into the collection chambers 320, 322. Accordingly, the liquid switching element 180 is not "squeezed" out onto the surface of the substrate 150.

The displacement tab 330 preferably extends at least partially into the main channel 120 when plate member 310 abuts substrate 150, as shown according to one embodiment in FIG. 4. In addition, displacement tab 330 is preferably configured to align in the void space formed between liquid switching element 180 deposited on adjacent contact pads (e.g., 162 and 164), as shown in FIG. 5.

In addition, the surface of displacement tab 330 is preferably made of a wettable material. Suitable materials include, but are not limited to metal(s) and metal alloys. The excess liquid switching element 180 wets to the displacement tab 330. Such an embodiment serves to enhance movement of the liquid switching element 180 into the collection chambers 320, 322.

It is understood that although displacement tab 330 is shown having a generally rectangular shape, it may be any suitable size and geometry. For example, the displacement tab 330 may have rounded corners to facilitate movement of the excess liquid switching element 180 in collection chambers 320, 322.

Preferably, collection chambers 320, 322 overlap into the main channel 120, as shown in FIG. 4. Such an embodiment provides a path or conduit from the main channel 120 into the collection chambers 320, 322 and does not block or otherwise inhibit movement of the excess liquid switching element 180.

It is understood that the volume adjustment apparatus 300 may have any suitable number of collection chambers 320, 322. Although the collection chambers 320, 322 are shown having a generally oval or elliptical geometry, collection chambers 320, 322 may have any suitable geometry and may be any suitable size. The specific design may vary to some extent, and may also depend on various design considerations. For example, the size and geometry of collection chambers 320, 322 may be based at least in part on the expected volume of excess liquid switching element 180 to be removed.

In addition, collection chambers 320, 322 may be formed in any suitable manner. In one exemplary embodiment, the collection chambers 320, 322 are etched (e.g., by sandblasting) in the plate member 310. However, other suitable embodiments are also contemplated as being with in the scope of the invention and may include, but are not limited to various layering and molding techniques. Such techniques are well-known to those skilled in the art and can be readily implemented after having become familiar with the teachings of the present invention.

The surfaces of collection chambers 320, 322 are preferably made of a wettable material. Again, suitable materials include, but are not limited to metal(s) and metal alloys. Providing a wettable material on the surface of the collection chambers 320 enhances movement of the excess liquid switching element 180 into the collection chambers 320. Such an embodiment also enhances retaining the excess liquid switching element 180 in the collection chambers 320, for example, when the volume adjustment apparatus 300 is removed from the substrate 150.

Figure 8:
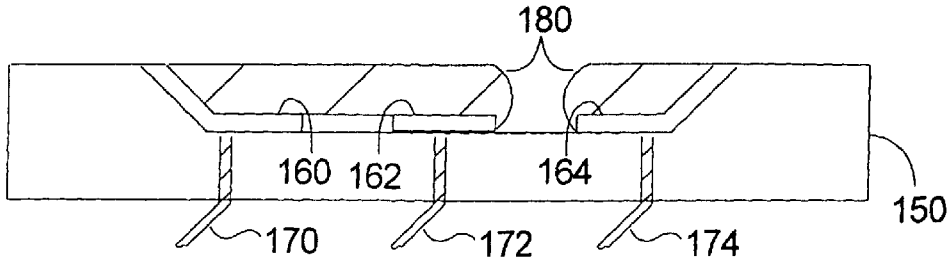
FIG. 8 is a side view of the substrate after removing the volume adjustment apparatus.

After the excess liquid switching fluid 180 is removed from the main channel 120 of the substrate 150, the volume adjustment apparatus 300 may be removed from the substrate 150. The desired amount of liquid switching element 180 remains in the main channel 120 as shown in FIG. 8.

After the volume adjustment apparatus 300 is removed, cover plate 110 may be assembled to the substrate 150. The cover plate 110 may be connected to the substrate 150 in any suitable manner. In one embodiment, an adhesive is used to connect the cover plate 110 to the substrate 150. In another embodiment, screws or other suitable fasteners may be used.

Figure 9A:
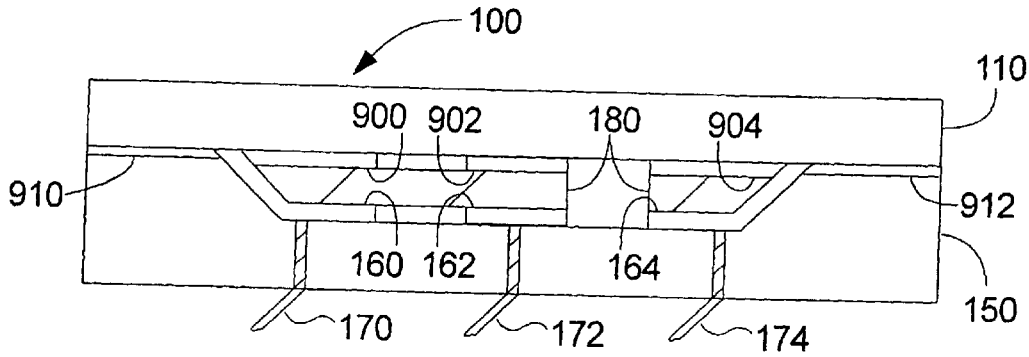
FIG. 9(*a*) is a side view of the assembled switch, shown in a first state.
Figure 9B:
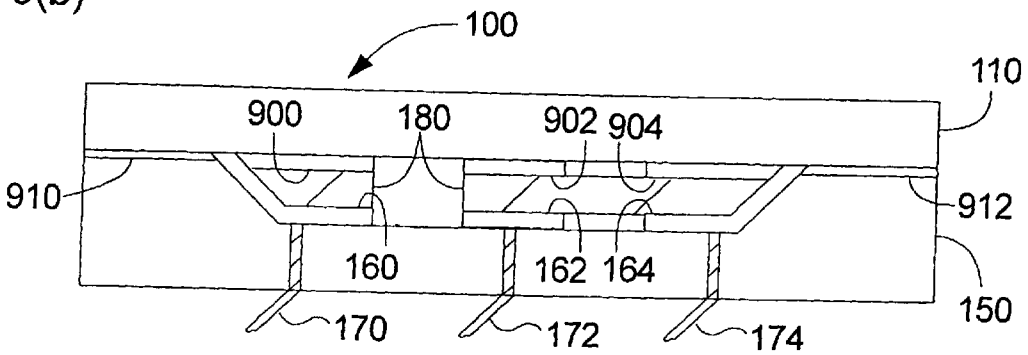

In addition, the outer perimeter of the switch 100 may be bonded or sealed (see FIG. 9(*a*) and FIG. 9(*b*)). For example, seals 910, 912 made of CYTOP® (commercially available from Asahi Glass Company, Ltd (Tokyo, Japan)) may be provided on the outer perimeter of the cover plate 110 and/or substrate 150.

Seal belts 900, 902, 904 may be provided on the cover plate 110 to promote wetting of the liquid switching element 180 to the cover plate 110 (see FIG. 9(*a*) and FIG. 9(*b*)). Wetting the liquid switching element 180 to the cover plate 110 facilitates movement of the liquid switching element 180 during a switching operation.

Seal belts 900, 902, 904 are preferably made of a wettable material to promote wetting of the liquid switching element 180. Suitable materials for use as seal belts 900, 902, 904 may include metal(s) and metal alloys, to name only a few. In one embodiment, seal belts 900, 902, 904 are made of one or more layers of thin-film metal. For example, the seal belts 900, 902, 904 may comprise a thin layer (e.g., about 1000 Å) of chromium (Cr), a thin layer (e.g., about 5000 Å) of platinum (Pt), and a thin layer (e.g., about 1000 Å) of gold (Au). The outermost layer of gold quickly dissolves when it comes into contact with a mercury (Hg) liquid switching element 180, and the mercury forms an alloy with the layer of platinum.

Following assembly, a break (e.g., gas-filled) is formed between at least two adjacent contact pads (e.g., 160 and 162). The liquid switching element 180 remaining in the main channel 120 can be used to effect a change of state in the switch 100, as described above.

Switch 100 may be produced according to one embodiment of the invention as shown and described with respect to FIG. 5 through FIG. 9(*a*) and 9(*b*). It is noted that FIG. 5 through FIG. 9(*a*) and 9(*b*) are cross sectional views of the volume adjustment apparatus 300 and substrate 150. The view of substrate 150 is such as would be seen taken along line C—C in FIG. 2(*b*). The view of volume adjustment apparatus 300 is such as would be seen taken along line C'—C' in FIG. 3.

Liquid switching element 180 is deposited on the substrate 150, as illustrated in FIG. 5. In one embodiment, liquid switching element 180 is deposited on each of the contact pads 160, 162, 164. Liquid switching element 180 need not be accurately measured, and suitable volumes of deposited liquid switching element 180 may form "swells" on the contact pads 160, 162, 164, Preferably, a larger volume of liquid switching element 180 is deposited on at least two adjacent contact pads (e.g., 160 and 162) to form a connection therebetween. Preferably, the liquid switching element 180 does not run over the sides of at least two other adjacent contact pads (e.g., 162 and 164) onto the substrate 150, forming a void or "disconnect" therebetween. It is also noted that liquid switching element 180 does not wet to the substrate 150 between the adjacent contact pads (e.g., 160, 162).

The volume adjustment apparatus 300 may be positioned adjacent the substrate 150 (FIG. 5). Although volume adjustment apparatus 300 may be positioned adjacent the substrate 150 prior to depositing the liquid switching element 180, the invention is not limited to this sequence. The volume adjustment apparatus 300 may then be moved toward the substrate 150.

Figure 6:
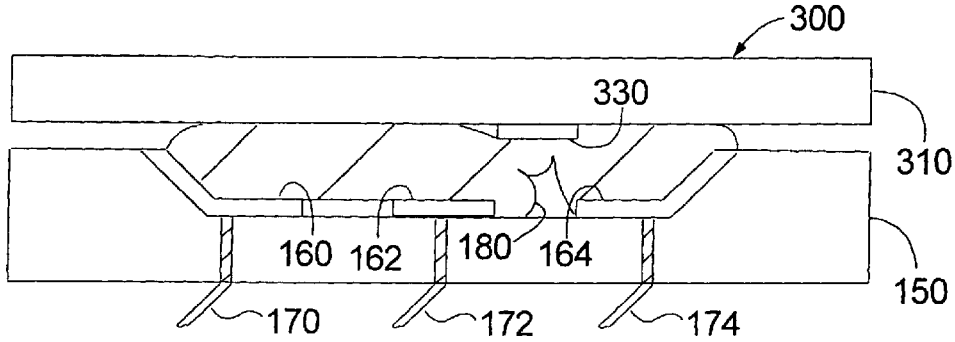
FIG. 6 is a side view of the volume adjustment apparatus moved toward the substrate portion of the switch.

As the volume adjustment apparatus 300 is moved toward substrate 150 (FIG. 6), the liquid switching element 180 comes into contact with plate member 310. Preferably, the liquid switching element 180 wets to displacement tab 330, which facilitates movement of the liquid switching element 180 into the collection chambers 320, 322, as illustrated in FIG. 6 (see also arrows 400, 402 in FIG. 4). A wettable material on the displacement tab 330 and in collection chambers 320, 322 facilitates movement of the liquid switching element 180 into the collection chambers 320, 322, so that the liquid switching element 180 is not squeezed out of the main channel 120 onto the surface of substrate 150.

Figure 7:
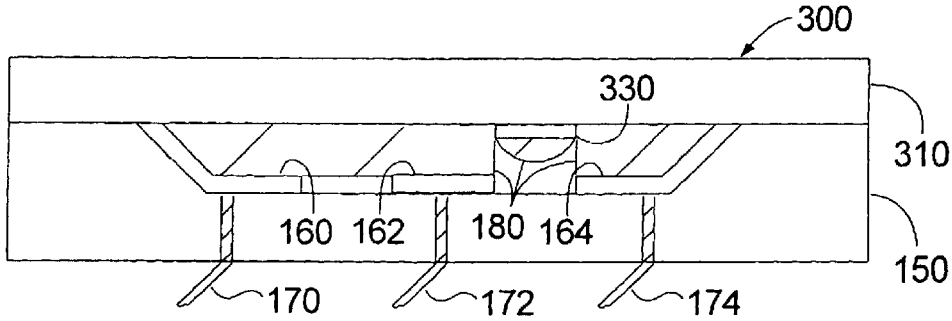
FIG. 7 is a side view of the volume adjustment apparatus contacting the substrate portion of the switch.

The volume adjustment apparatus 300 may continue to be moved toward the substrate 150 until the plate member 310 makes contact with the substrate 150, as shown in FIG. 7. Excess liquid switching element 180 automatically moves into the collection chambers 320, 322 (i.e., without any additional steps by the user), and may continue to automatically move into the collection chambers 320, 322 after plate member 310 makes contact with the substrate 150. For example, liquid switching element 180 may be removed from between contact pads 162 and 164, forming a void space or "break" in the switch.

The assembly process may include pausing or slowing movement of the volume adjustment apparatus 300 toward the substrate 150 for a time sufficient to allow liquid switching element 180 to equilibrate. The liquid switching element 180 is shown in FIG. 7 according to one embodiment in equilibrium. According to this embodiment, the liquid switching element 180 on contact pad 162 and 164 extends substantially perpendicular to the substrate 150 and is aligned along the edge of contact pads 162 and 164. Excess liquid switching element 180 is removed into collection chambers 320, 322, and may also be wet to displacement tab 330.

Of course it is understood that pausing or slowing movement of the volume adjustment apparatus 300 may occur more than once and at any step during the assembly process. For example, a pause may occur prior to the volume adjustment apparatus 300 contacting the substrate 150 (e.g., FIG. 6) or after the volume adjustment apparatus 300 contacts the substrate 150 (e.g., FIG. 7).

The volume adjustment apparatus 300 may then be removed from the substrate 150, as shown in FIG. 8. Preferably, most if not all of the liquid switching element 180 in the collection chambers 320, 322 and on displacement tab 330 remains on the volume adjustment apparatus 300 and is removed therewith. The desired volume of liquid switching element 180 for performing a switching function remains on the substrate 150 in main channel 120.

Assembly of the switch 100 may continue by positioning the cover plate 110 against the substrate 150, as shown in FIG. 9(*a*) and FIG. 9(*b*). The cover plate 110 may be connected to the substrate 150 in any suitable manner, as discussed above. Preferably, the cover plate 110 is also sealed to the substrate 150 about the perimeter, also as discussed above (e.g., using Cytop®).

The switch 100 may be operated as described above. By way of brief illustration, switch 100 is shown in a first state in FIG. 9(*a*) wherein the liquid switching element 180 makes a conductive path between contact pads 160 and 162. Drive element 200 (FIG. 2(*a*) and FIG. 2(*b*)) may be operated to effect a change in state of switch 100, as discussed above. Operation of the drive element 200 causes the liquid switching element 180 to move toward the other end of the main channel 120, wherein the liquid switching element 180 makes a conductive path between contact pads 162 and 164, as shown in FIG. 9(*b*). Drive element 202 (FIG. 2(*b*)) can be operated to change the state of the switch 100 back to the first state (FIG. 9(*a*)).

It is readily apparent that switch 100 and production thereof according to the teachings of the present invention represents an important development in the field. The present invention allows for variance in the volume of liquid switching element 180 that is measured and delivered into the main channel 120. Excess liquid switching element 180 is removed by the volume adjustment apparatus 300. Accordingly, the present invention corrects for volumetric errors that may be introduced during assembly of compact switching devices (e.g., LIMMS). For example, the present invention corrects volumetric errors resulting from the tolerance of the delivery devices. The present invention also corrects for volumetric errors resulting from variations in the dimensions of the main channel 120 itself. The method is fast and easy to use, lowering production costs and increasing production yield.

Having herein set forth preferred embodiments of the present invention, it is anticipated that suitable modifications can be made thereto which will nonetheless remain within the scope of the present invention.

What is claimed is:

1. A volume adjustment apparatus for a switch, comprising:

a plate member sized to fit over a main channel in the switch, said plate member displacing an excess of a liquid switching element from the main channel of the switch;

at least one collection chamber formed in said plate member, said at least one collection chamber overlapping the main channel of the switch to receive the displaced excess liquid switching element.

2. The volume adjustment apparatus of claim 1, wherein said at least one collection chamber is wettable by the liquid switching element.

3. The volume adjustment apparatus of claim 1, wherein said at least one collection chamber has a substantially elliptical shape.

4. The volume adjustment apparatus of claim 1, further comprising a displacement tab aligned adjacent said at least one collection chamber on said plate member.

5. The volume adjustment apparatus of claim 4, wherein said displacement tab is wettable by the liquid switching element.

6. The volume adjustment apparatus of claim 4, wherein said displacement tab extends at least partially into the main channel of the switch when said plate member abuts the switch.

7. The volume adjustment apparatus of claim 4, wherein said displacement tab aligns between separate volumes of liquid switching element in the main channel of the switch.

8. The volume adjustment apparatus of claim 1, wherein the plate member with the excess liquid switching element is removable from the switch.

* * * * *